US008393359B2

(12) United States Patent
Molaro et al.

(10) Patent No.: US 8,393,359 B2
(45) Date of Patent: Mar. 12, 2013

(54) DUAL PURPOSE BITUMEN/DILUENT RAILROAD TANK CAR

(75) Inventors: Greg Molaro, Balzac (CA); Glen F. Perry, Calgary (CA)

(73) Assignee: Altex Energy Ltd., Calgary, Alberta (CA)

( * ) Notice: Subject to any disclaimer, the term of this patent is extended or adjusted under 35 U.S.C. 154(b) by 200 days.

(21) Appl. No.: 13/032,416

(22) Filed: Feb. 22, 2011

(65) Prior Publication Data

US 2011/0139298 A1 Jun. 16, 2011

Related U.S. Application Data

(62) Division of application No. 12/272,720, filed on Nov. 17, 2008, now abandoned.

(51) Int. Cl.
*B65B 1/20* (2006.01)
*B61D 27/00* (2006.01)
*B65F 9/00* (2006.01)

(52) U.S. Cl. ..... 141/11; 141/82; 105/451; 414/809

(58) Field of Classification Search ..... 141/11, 141/82; 105/451; 414/809; 165/41
See application file for complete search history.

(56) References Cited

U.S. PATENT DOCUMENTS

| | | | | |
|---|---|---|---|---|
| 1,706,084 | A | | 3/1929 | Steinmeyer et al. |
| 1,858,610 | A | | 5/1932 | Banning, Jr. |
| 1,864,990 | A | | 6/1932 | Endsley |
| 2,145,614 | A | | 1/1939 | Stambaugh |
| 2,545,371 | A | | 3/1951 | Mojonnier et al. |
| 2,558,648 | A | | 6/1951 | Gausmann |
| 2,772,784 | A | | 12/1956 | Cyphers et al. |
| 2,907,284 | A | | 10/1959 | Folmsbee |
| 3,336,879 | A | | 8/1967 | Halcomb |
| 3,468,300 | A | | 9/1969 | Geyer et al. |
| 3,487,532 | A | | 1/1970 | Phillips |
| 3,742,866 | A | | 7/1973 | Needham et al. |
| 4,002,192 | A | * | 1/1977 | Mowatt-Larssen ..... 141/35 |
| 4,266,580 | A | * | 5/1981 | Dixon ..... 141/35 |
| 4,414,462 | A | | 11/1983 | Price |
| 4,466,356 | A | | 8/1984 | Messersmith et al. |
| 4,515,189 | A | * | 5/1985 | Mowatt-Larssen ..... 141/11 |
| 4,603,733 | A | * | 8/1986 | Loevinger ..... 165/41 |
| 4,624,189 | A | | 11/1986 | Loevinger |
| 5,468,117 | A | * | 11/1995 | Lobko et al. ..... 414/809 |
| 5,531,240 | A | * | 7/1996 | Kelada ..... 137/15.16 |
| 6,347,589 | B1 | | 2/2002 | Loevinger |
| 6,357,363 | B1 | | 3/2002 | Miltaru |
| 7,451,789 | B2 | * | 11/2008 | Fiore ..... 141/198 |
| 2006/0254620 | A1 | | 11/2006 | Olsen et al. |

OTHER PUBLICATIONS

CFR Title 49, Part 179 ("Specification for Tank Cars"), Subparts A through F and Appendices A and B, as that regulation existed at Oct. 21, 2009, 87 pp.

UTLX Design Details—"Header-Heater System", Nov. 1978.

Trans-Action, The Transportation Management Quarterly From Union Tank Car Company, p. 11, "The UTLX Header-Heater System", Winter 1986.

Union Tank Car Blue Book, Tank and Hopper Car Specifications—"Tank Car Components—Heater Pipes", Jan. 1993.

* cited by examiner

*Primary Examiner* — Timothy L Maust
(74) *Attorney, Agent, or Firm* — Haynes and Boone, LLP

(57) ABSTRACT

A dual-purpose railcar is provided, designed for hauling of bitumen or diluent, optimized to provide transport of bitumen to a destination and transport of diluent in the return trip of the car.

2 Claims, 2 Drawing Sheets

DUAL PURPOSE BITUMEN/DILUENT RAILROAD TANK CAR

CROSS-REFERENCE TO RELATED APPLICATIONS

The present application is a Divisional application of Co-pending U.S. patent application Ser. No. 12/272,720 filed on Nov. 17, 2008, incorporated herein by reference.

FIELD OF THE INVENTION

This invention has to do with railcar transport of bitumen, typically from a production site to a refining or upgrading site and the return of the railcar, at least part of the return trip having the railcar transporting diluent instead of deadheading. It is proposed that diluent would be returned from a point along the return trip back to the bitumen production site to aid in production, refining, as fuel, or as diluent in dilbit for handling or transport.

BACKGROUND OF THE INVENTION

Rail tank cars are used in bulk transportation to transfer petroleum products from one location to another. One skilled in the art also knows that specialized rail cars exist for the transport of asphalt or bitumen and specialized rail cars exist for diluent and similar light hydrocarbons such as gasoline ("diluent"). Asphalt is defined as residual crudes that have a specific gravity of about 1.04 and diluents are liquid hydrocarbons which have specific gravities of about 0.830 or less.

The approval for railroad tank car designs, materials, construction or alteration of tank cars are prescribed by the Executive Director Tank Car Safety, AAR (Association of American Railroads) and the Tank Car Committee. The US Department of Transportation in conjunction with the AAR have classified asphalt tank cars and diluent tank cars as DOT 111A100W1 (AAR 211A100W1). Both asphalt tank cars and diluent tank cars share common certification requirements for tank design and construction, type of steel, welding, repairs, documentation, mounting, coupler vertical restraint systems, pressure relief devices, and markings. Both these types of cars are classified as general purpose non-pressure tank cars (Department of Transportation Part 179 Specifications for Tank Cars: Subpart D—Specifications for Non-Pressure Tank Car Tanks: Classes DOT—111AW and 115AW).

However, asphalt cars and diluent tank cars have several significant differences:

Asphalt tank cars are smaller than diluent tank cars because the density of the asphalt is much higher. The density of liquid heated asphalt loaded into tank cars is typically in the range of 975 kg/cubic meters. The density of diluent typically loaded into tank cars at ambient temperature is in the range of 675 to 830 kg/cubic meters. Because tank cars are essentially limited to 286,000 lbs in maximum gross weight, and assuming that the asphalt car empty weighs 82,500 lbs, it is not logical to build an asphalt tank car with a shell capacity greater than about 25,500 gals (US), with a loaded capacity of 25,000 gals (at 98% of full load). The reason is once 25,000 gallons of 975 kg/cubic meters asphalt are placed in its tank the total gross rail load of the rail tank car is about 286,000 lbs.

Diluent rail cars are similar to general purpose gasoline, diesel and ethanol rail cars for reasons of interchangeability and fungability. The tank cars and products are interchangeable because the density and vapour pressure of these various products are similar. A 286,000 lb gasoline/diluent tank car can be designed to have a shell capacity of around 33,000 gallons (US), with a loaded capacity of 32,300 gals (at 98% loaded) and it has a vehicle weight of 72,000 lbs when empty. If the liquid diluent (or similar) product with a density of about 795 kg/cubic meters is placed in this rail car's tank then the rail car will reach its maximum allowable weight (286,000 lbs) when 98% loaded, at 32,300 gallons of diluent. The density of gasoline is about 720 kg/cubic meters, ethanol is 795 kg/cubic meters and diesel is about 830 kg/cubic meters. Diluents used for bitumen are also in this range.

This aspect, the railroad's weight restriction, is a major design factor when designing a tank car. This restriction is known by those skilled in the art.

Because asphalt does not flow efficiently at ambient temperatures, asphalt cars are insulated and, typically, externally heat traced. Heat tracing is almost always done with a heat exchange system of a steam coil affixed to the tank. Steam lines are attached to the tank car when it reaches an unloading facility. The steam in the coil transfers heat to the tank and that heat radiates into the asphalt increasing its fluidity. The steam may be supplied from either a stationary or a portable boiler. These cars are called coiled, insulated, non-pressurized tank cars. Because diluent does not "solidify" or become viscous at even low ambient temperatures, diluent cars are not heat traced. These diluent cars are called non-coiled, non-insulated, non-pressurized tank cars.

As steam lines add significant empty weight to the tank car, they are not installed unless required by the cargo for viscosity reduction purposes. This is known to one skilled in the art.

The tank on a diluent tank car requires a thicker head shell made of stronger steel, or a protective head shield to reduce the possibility of tank rupture if the car derails or is in collision. This requirement is set out by the DOT in section 179.169 (a) (b) (c) "Tank-head puncture resistance systems" of its Specifications for Tank Cars and Canada's National Transportation Act, Railway Act. Diluent tank cars also require the installation of a pressure relief valve (as set by the AAR Appendix A and DOT Section 179.15: Pressure relief devices), valve protection at the top of the tank (around the vacuum and safety pressure relief valves), and protective steel around the bottom discharge valve (DOT Specifications for Tank Cars—Section 179.200 and AAR Specifications for Tank Cars paragraphs E9.00 and E10.00).

This requirement for added safety features for diluent railcars is known by those skilled in the art.

Gasket materials must be selected from a group of materials that are effective with the commodity being transported and not negatively affected thereby. The US Department of Transportation (DOT) has made these aspects a requirement for diluent transportation by rail.

This requirement for special gaskets, seals, tubing, and valves suitable for use with diluent type solvents in transport is known by those skilled in the art.

Asphalt is loaded and unloaded into insulated tank cars at high temperature that the asphalt is liquefied to be pumped. The temperature of the asphalt during loading and unloading is typically between 300 deg F. and 325 deg F. (~150 deg C.). However, diluent is placed in a tank car at ambient temperature, not elevated temperatures, to avoid dangerous or costly boiling/evaporation of any volatile hydrocarbon components.

These very different loading and unloading temperatures for diluent and asphalt or bitumen are known by those skilled in the art.

Because differences between the two types of tank cars are significant, tank car manufacturers do not build tank cars that meet the DOT requirements and combine asphalt and diluent transportation.

PRIOR ART

There are numerous prior patents and other publications related to railroad tank cars some relevant ones of which are:

| | |
|---|---|
| A. Tank Car design | |
| Department of Transport (DOT) Research and Special Programs Administration, Part 179-Specifications for Tank Cars | |
| B. Tank structure and supports | |
| 2,907,284 C M Folmbee: | Frameless tank car |
| 3,336,879 S P Halcomb: | Frameless tank car sill design |
| 3,487,532 E. A. Phillips: | Method of expanding the tank car to make it larger |
| 6,357,363 Daniel Miltaru: | Frameless tank car |
| C. Head protection | |
| 4,466,356 Messersmith et al | Head end shield retrofit design and method |
| D. Heating methods | |
| 1,706,084 J W Steinmeyer | Tank car steam coil design |
| 2,145,614 P H Stambaugh | Method of heating and insulating tank cars |
| 2,545,371 T Mojonneier et al | Tank car heat exchange coil design |
| 3,468,300 W. T. Geyer et al | Heating mechanism for insulated tank cars |
| 4,414,462 Price | Tank Car heating system |
| 4,603,733 Loevinger | Tank car steam coil design |
| 6,347,589 Loevinger | Railway tank car having a heating system |
| E. Tank design | |
| 1,858,610 T A Banning, Jr. | Tank car for gasoline, naphtha |
| 1,864,990 L E Endsley | Tank car dome design |
| 2,558,648 R W Gausmann | Tank car insulated and heating design |
| 2,772,784 J F Cyphers et al | Tank car for transporting chocolate |
| 3,742,866 Needham et al | Tank car sloping bottom design |
| 4,624,189 Loevinger | Tank car heated Outlet valve |

SUMMARY OF THE INVENTION

In today's market, there is a need for a railroad tank car which can move bitumen (nominally heavy oil with a density of 930 to 1050 kg/cubic meters) from heavy oil producing areas like Alberta to terminals and refineries which have the ability to refine these very heavy crudes. However, there is also a need to transport diluent (such as hydrocarbons with less than a density of 830 kg/cubic meters) back to these oil fields. The diluent serves two purposes. First, it is used in the production process to separate the heavy crudes from sand and water. Second, it is mixed with the bitumen to produce an oil called Dilbit or Synbit that meets or exceeds standard pipeline specifications of viscosity and density for transport.

The traditional way to transport bitumen to market is to add a diluent to the bitumen until the viscosity of the mixture is sufficiently reduced so that the blend can be transported by conventional pipeline. Often, the diluent is a lighter hydrocarbon (pentane, hexane or synthetic crude), within the range identified here.

This invention describes an alternative form of combined transport employing heated, insulated rail tank cars. These cars are designed to be partially (by volume) filled with bitumen, typically no more than 90% but to the maximum allowable weight capacity of the car or the rail line. The cars then move from the field to an unloading facility. In a normal oil transportation service the rail cars are returned to the oil field empty. Rather than bringing these cars back empty, with this inventive railcar design, which meets or exceeds DOT safety requirements, it is possible to return the novel cars full (by volume) of diluent back to the bitumen source in the same car. This requires a rail tank car which is designed to handle both commodities, with features not at first obvious to one skilled in the art of rail tank car design or use.

This invention is premised on the concept that those parties manufacturing dilbit for pipeline transport require an external supply of diluent either for removal of the sand and water and/or blending dilbit for pipeline transportation. Thus, diluent is needed in the field and the back-haul of diluent has economic utility greater than the cost or inefficiency of the novel railcar design.

DETAILED DESCRIPTION

Figure 1:
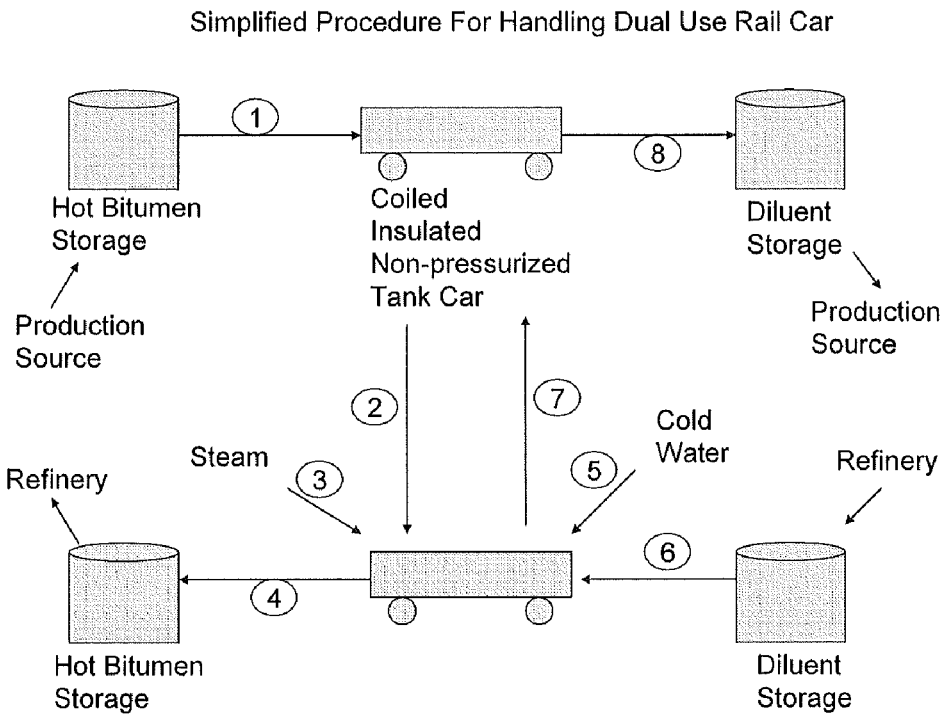
FIG. 1 is a schematic flow-diagram showing a preferred transport process of the invention.
Figure 2:
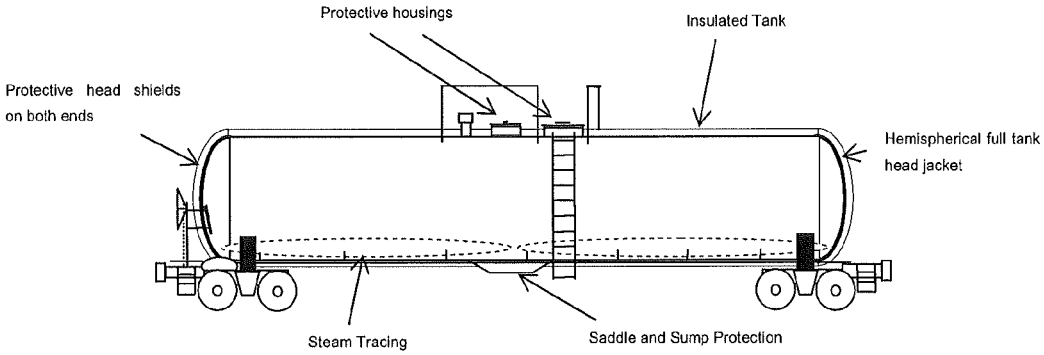
FIG. 2 is a cross sectional side elevation of a preferred embodiment of a railway tank car of this invention, to provide context.

In this invention and with reference to FIG. 1, the steps expected in the use of the specially designed two-function railcar include:

1. Hot bitumen is transferred from a hot bitumen storage tank to the coiled, insulated, non-pressurized rail tank car using a standard oil pump.
2. The rail tank car is transported from the loading station, preferably at or near a production source, to an unloading station, preferably near a refinery.
3. Steam is injected into the tank car's heat exchanger coils to reheat the bitumen to a temperature required to liquefy it sufficiently to enable it to be pumped off the tank car and unloaded.
4. The hot bitumen is transferred from the tank car to a hot bitumen storage tank using a standard oil pump.
5. At a diluent loading station, preferably close to the bitumen unloading station, water is injected into the coils to cool the tank car to a temperature suitable to prevent flashing or guide evaporation of any significant part of the diluent.
6. The diluent is transferred from the storage tank to the tank car using a standard pump.
7. The tank car is transported from the loading station to an unloading station, preferably near a production source.
8. The diluent is transferred from the tank car to a diluent storage tank using a standard pump.

Because bitumen has a higher density than diluent, and the capacity of tank cars to carry a commodity is based on the total weight of the car plus the cargo, the car size and design of a dual purpose car for hauling widely disparate fluid hydrocarbon commodities needs to be optimized such that it maximizes the transport of the sum of the two commodities multiplied by the product price differential between the producing location and the consuming market. In practice, this involves designing a tank car that takes into account both volume restrictions and maximum rail car and load weight. In almost all rail applications, the total loaded weight of the rail car is limited by the track and the type of support underneath the track. In almost all rail applications, the maximum volume of the tank cars is limited as to height and width by factors such as en route bridge heights. The one variable in the tank car design process that is not exogenous is the tank car length, although this too can be limited by exogenous factors related to railroad siding length, track turning radius, and loading/unloading rack geometries. Certain standards have emerged with regards to tank car length. One observes that tank cars that carry heavy cargo such as asphalt are typically about 53 feet in length, medium density products such as gasoline are 60 feet in length, and light products such as propane are 68 feet in length. This means that standards that have evolved for the two different products of asphalt and gasoline are different with regards to rail car length.

Any tank car designed for dual use with different density fluid hydrocarbon products will inevitably be designed to be able to handle the maximum weight of the car in one of the directions (for example when carrying bitumen) and the maximum volume of the car in the other direction (when carrying diluent). Given that the ratio between the weight of the cargo and the weight of the steel in the tank is approximately 7:1, an economic optimization analysis indicates that the greatest economic benefit is achieved by designing a dual use tank car which fully loads the tank cars volumetrically with the lower density fluid, in this case the diluent. We have determined that this requires a non-pressurized, insulated, coiled tank car that meets DOT, AAR and CTC safety requirements and has approximately 30,000 gals of capacity and is approximately 60 feet long.

This novel tank car will be fully loaded with bitumen at a loading capacity much less than 98% by volume, the current standard. The actual loading capacity will be equal to the ratio between the density of the two products, the hot bitumen and cold diluent.

Cold diluent, using a standard 30,000 gal tank car weighing about 82,000 lbs empty, has a density of approximately 830 kg/cubic meter. We have determined that the hot bitumen has a very narrow range of product densities, even though the various raw bitumens identified in nature have a very broad range of densities at ambient temperatures. This occurs because the main design specification will be that the rail car must be loaded and unloaded in a finite amount of time and the key physical characteristic that affects the loading and unloading time is the viscosity of the fluid, which requires an elevated loading temperature of the bitumen. Through testing, we have identified that the heavier is the bitumen, the hotter it must be to achieve the viscosity specification. We have also identified that the bitumen density drops as it heats up (the fluid expands with increases in temperature). Therefore, the density of the bitumen as it is loaded and unloaded at a suitably elevated temperature defines a much narrower range of densities than is seen amongst raw bitumens at ambient temperatures. This is shown in the table below, where the raw bitumen at ambient (15.6° C.) describes a 3.8% range in density, while the density at 570 cP of viscosity describes a 1.2% range of density. The table derives from actual testing that was done on three different bitumen samples.

Relationship of Density to Viscosity of Three Different Bitumens

| Bitumen Sample # | 1 | 2 | 3 |
|---|---|---|---|
| Density @ 15.6° C. (kg/cubic meters) | 977.9 | 1002.3 | 1015.3 |
| Temperature @ 570 cP viscosity (° C.) | 49.0 | 68.6 | 90.6 |
| Density at above temperature (kg/cubic meters) | 956.3 | 966.7 | 967.3 |
| Temperature @ 350 cP viscosity (° C.) | 60.0 | 76.0 | |
| Density at above temperature (kg/cubic meters) | 949.3 | 961.8 | |

It is now expected that all bitumens will show this characteristic and, having done these novel experiments with the optimization features of this invention as a motivation, it is apparent that the density of hot bitumen loaded into the more dual use tank car of this invention will be approximately equal to 950 kg/cubic meter at the temperatures required to reach the bitumen viscosity required to load or unload the car. The volumetric analysis of a car, assuming a diluent load that will not exceed about 830 kg/cubic meter loaded density and a hot bitumen load that will be approximately equal to 950 kg/cubic meter, indicates that the tank car, when loaded with bitumen, will not exceed a loading capacity of 87% (830/950).

Further, the car design deals with issues that can potentially arise from the contamination of the diluent by the bitumen. This design constraint means that virtually all of the bitumen needs to be unloaded from the tank car before the car is filled with diluent. In practice, this means the bitumen will be heated to come to a high fluidity state during the unloading procedure. The proposed method to accomplish this goal is by employing steam to heat the tank car and its bitumen through heat exchanges on or in the car upon (and if necessary, during) the unloading process. This is achieved by heating the tank car using a steam coil for at least thirty minutes. This practice involves designing a car that is insulated to conserve the heat imparted to the bitumen when the tank car is loaded, then adding additional heat to raise the temperature of the bitumen until the bitumen has high fluidity for unloading.

After the car is emptied of bitumen, it is still hot from the unloading process. If diluent were placed in the hot tank car portions of it would vaporize causing waste and increasing hazard. We have determined that the external steam coil or heat exchanger on or in the car can be flushed with water at or near ambient temperature for a reasonably short period of time to reduce the temperature of the tank to a point it can be loaded with diluent without having the diluent vaporize. Currently, this cooling activity is not done with asphalt-type tank cars because they are not loaded with diluent-type hydrocarbons after unloading (or at all), due to the lack of diluent style safety features on the asphalt car. Hence, this process step, changing the temperature state of the tank, is not known by or obvious to one skilled in the art.

For safety reasons, because the consequence of a bitumen spill is much less dangerous than a diluent spill, the design of this dual-purpose car involves designing the car to meet the more stringent railroad safety code for diluent cars. The preferred car design is therefore based on an insulated rail car that can be heated upon delivery of the bitumen into the market, the car can then be cooled prior to introduction of the more volatile diluent to avoid flashing the diluent, and the rail car has the safety features required for diluent type cars, primarily involving a reinforced head end at the front of the car and safety reinforcement around the bottom and other valves of the rail car.

The invention includes the design and manufacture of an optimized dual purpose asphalt-diluent railroad tank car. The entire unit is self contained and no ancillary equipment is required for the tank car to complete the transport task for which it was designed. Thus this dual purpose tank car can be used anywhere there are appropriate loading and off-loading facilities.

The invention may be described as a railroad tank car whose tank has been adapted to meet DOT, AAR, and CTC ("Canadian Transport Commission") safety requirements for the purpose of transporting diluents which include: synthetic crude, light crude, diesel fuel, gasoline, pentane, hexane, naphtha and or blends of these hydrocarbons. Additionally, the tank has been insulated and a steam heat coil has been attached so that it may be used to transport asphalt, bitumen, bunker or any other hydrocarbon which requires heating so that its fluidity increases at the time of loading or unloading.

As the first step in the refining process of bitumen is to heat the bitumen for distillation, preservation of the heat energy in an insulated tank car and the subsequent storage (as hot bitumen) has additional economic utility.

Although there is an economic benefit in heat conservation, we have found that there is no business case in preheating the tank car before loading the bitumen. For example, if the mass of the bitumen to be loaded is 198,000 lbs and its temperature is 120° C. and the temperature of the railcar's 30,000 lb tank is 20° C. then (assuming the heat capacity of the bitumen is 2 joules/gram/° C. and the heat capacity of the steel tank is 0.5 joules/gram/° C.) the temperature of the tank and bitumen after loading and when at equilibrium, should be about 116° C. This temperature loss is a negligible amount (approximately 4° C.) and does not warrant the deployment of capital (a boiler, steam piping, etc.) required to pre-heat the car, as it does not materially affect the loading process or provide other utility.

In an embodiment of the process of this invention, the empty weight of a dual purpose railroad tank car is about 82,000 lbs. The shell capacity of the tank car is 29,200 US gallons. The tank car is capable of being fully loaded by weight by being partially filled by volume with hot bitumen. Because the bitumen is hot, its density is approximately 950 kg/cubic meters. Hence, when the tank car is filled by weight to 286,000 lbs, approximately 25,700 gals of bitumen are placed in the tank car. This is 88% of the tank car's volumetric capacity but 100% of its weight capacity. Of course, the weight of the car and load must also be tailored to the maximum weight capacity of the line and other similar known constraints.

The tank car is then hauled to a refinery or terminal. Steam hoses are connected to conventionally designed heat exchange means in or on the tank and the temperature of the tank and the bitumen are raised to about 100° C. A valve at the bottom of the tank car is opened and the hot bitumen is flowed out of the tank car and into a hose which is connected to a pipe. The pipe and a pump move the bitumen to a storage tank.

After the tank is drained (approximately 30 minutes), the steam hoses are removed and they are replaced with water hoses. Alternatively, the same hoses can be used and the steam supply is shut off and the hoses are filled with water from a steam/water manifold. In either case, water is pumped through the tank car's steam coil and the tank is cooled to a temperature which is below the flash point of the diluent which will next be loaded; the water having been at a temperature to effect this cooling, preferably at or near ambient temperatures.

After the tank car is cooled with water, the hoses are removed and the tank car is filled with diluent. Because the tank car has been cooled from its heated state at the unloading of the bitumen stage to at or near ambient temperature, the diluent does not flash to form a wasteful or hazardous vapor. The tank car is then filled to 98-99% of its volumetric capacity with diluent. If the density of the diluent is 675 kg/cubic meters, and the volume of diluent loaded in the tank car is 28,900 gallons (US), then the weight of the cargo is 162,750 lbs. The loaded total weight of the tank car is 244,750 lbs, equal to approximately 85.5% of the total weight capacity of the tank car of 286,000 lbs. If the density of the diluent is 846 kg/cubic meters, the car would be fully loaded by weight.

This tank car is transported back to the production location. Similarly, it may be emptied at a terminal or refinery en route to the bitumen production area, or may be filled at a different loading station that at the unloading point.

In the preceding description, for purposes of explanation, numerous details are set forth in order to provide a thorough understanding of the embodiments of the invention. However, it will be apparent to one skilled in the art that these specific details are not required in order to practice the invention.

The above-described embodiments of the invention are intended to be examples only. Alterations, modifications and variations can be effected to the particular embodiments by those of skill in the art without departing from the scope of the invention, which is defined solely by the claims appended hereto.

What is claimed is:

1. A process of efficient bitumen transport by a dual purpose railway tank car comprising the steps of:

a. Heating bitumen and flowing the bitumen into an insulated tank of the tank car until the car reaches its maximum weight load;

b. Transporting the heated bitumen to a destination by rail;

c. Heating the bitumen in the insulated tank by application of steam supplied at the destination through a heat exchanger in or on the insulated tank containing the bitumen;

d. Flowing the heated bitumen out of the insulated tank until the tank is emptied;

e. Sufficiently cooling the insulated tank by provision of water or a fluid at suitable temperature to the heat exchanger in the insulated tank to avoid flash evaporation of its next load;

f. Loading the tank car to its maximum volumetric capacity with diluent;

g. Transporting the diluent by rail to another destination; and h. Unloading the diluent from the tank car.

2. The process of claim 1, but with the steps in the order f, g, h, a, b, c, d, e.

* * * * *